US009647317B2

(12) United States Patent
Lee et al.

(10) Patent No.: US 9,647,317 B2
(45) Date of Patent: May 9, 2017

(54) RADIO COMMUNICATION MODULE

(71) Applicant: SAMSUNG ELECTRO-MECHANICS CO., LTD., Suwon-Si (KR)

(72) Inventors: Gye Won Lee, Suwon-Si (KR); Yeong Yeol Jo, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 378 days.

(21) Appl. No.: 14/328,674

(22) Filed: Jul. 10, 2014

(65) Prior Publication Data

US 2015/0029074 A1 Jan. 29, 2015

(30) Foreign Application Priority Data

Jul. 26, 2013 (KR) ..... 10-2013-0089056

(51) Int. Cl.

| | |
|---|---|
| ***H01Q 1/38*** | (2006.01) |
| ***H01Q 1/00*** | (2006.01) |
| ***H01Q 1/50*** | (2006.01) |
| ***H01Q 1/24*** | (2006.01) |

(52) U.S. Cl.

CPC ..... *H01Q 1/002* (2013.01); *H01Q 1/242* (2013.01); *H01Q 1/50* (2013.01)

(58) Field of Classification Search

CPC ..... H01Q 1/002; H01Q 1/50

USPC ..... 343/700 MS, 850, 702, 700, 906

See application file for complete search history.

(56) References Cited

U.S. PATENT DOCUMENTS

| | | | | |
|---|---|---|---|---|
| 5,912,647 | A * | 6/1999 | Tsuru | H01Q 1/22 343/700 MS |
| 2008/0117117 | A1* | 5/2008 | Washiro | H01Q 1/2225 343/850 |
| 2009/0289860 | A1* | 11/2009 | Lee | H01Q 7/06 343/702 |
| 2013/0021208 | A1* | 1/2013 | Seok | H01Q 23/00 343/700 MS |

FOREIGN PATENT DOCUMENTS

| | | |
|---|---|---|
| KR | 10-0730085 B1 | 6/2007 |

* cited by examiner

*Primary Examiner* — Peguy Jean Pierre
(74) *Attorney, Agent, or Firm* — NSIP Law

(57) ABSTRACT

Disclosed herein is a radio communication module, including: a printed circuit board provided with a receiving unit receiving a radio wave and provided with a via hole; an antenna including a connector which has a transmitting unit connected to the receiving unit formed thereat and forms a ring part outwardly bent at a tip thereof and forms a cut part at a circumference thereof so that the ring part is elastically deformed so as to be inserted and fastened into the via hole; a ground GND formed on the printed circuit board; and a discharge unit disposed between the receiving unit and the ground and including an ESD diode and a discharge line guiding electrostatic discharge (ESD) introduced from the outside to the ground.

11 Claims, 3 Drawing Sheets

RADIO COMMUNICATION MODULE

CROSS REFERENCE TO RELATED APPLICATION

This application claims the benefit of Korean Patent Application No. 10-2013-0089056, filed on Jul. 26, 2013, entitled "Radio Communication Module", which is hereby incorporated by reference in its entirety into this application.

BACKGROUND OF THE INVENTION

1. Technical Field

The present invention relates to a radio communication module.

2. Description of the Related Art

Generally, Wi-Fi is a wireless LAN technology which may realize powerful wireless communications by combining high fidelity with a wireless technology, in which the wireless LAN means a type of constructing a network using a radio wave, light, or the like, without using a wired line at the time of constructing a network.

Products for consumer electronics including a set top box, a television, a printer, a notebook computer, and the like may be wirelessly connected to each other by a radio communication module including the Wi-Fi. That, the products for the CEs include the radio communication module, and thus may be wirelessly connected to each other.

In this case, the products for the CEs include an external patch antenna (ANT) which considerably affects performance of the Wi-Fi, in which the external patch antenna is generally connected to the radio communication module by using a UFL connector.

This has been disclosed in detail in Patent Document 1 which will be described. That is, according to the Patent Document 1, the antenna is connected to the radio communication module by mounting an antenna connector in the radio communication module and then connecting an antenna cable connector to the antenna connector.

Therefore, in order to connect the antenna to the radio communication module as described in the above Patent Document 1 which is a prior art, since the antenna connector mounted in the radio communication module and the antenna cable connector connected to the antenna connector, that is, two connectors are used, high material costs may be required and the connectors may be separated from each other during the use.

Meanwhile, since the typical radio communication module including the above Patent Document 1 is vulnerable to discharging, for example, the embedded circuit devices may be damaged by spark, and the like which occurs at the time of handling the products for the CEs or electrostatic discharge, and the like which is introduced through the antenna. Therefore, attempts to prevent damages due to the electrostatic discharge have been conducted in many different fields, but the effectiveness is problematic.

PRIOR ART DOCUMENT

Patent Document (Patent Document 1) KR10-0730085 B1

SUMMARY OF THE INVENTION

The present invention has been made in an effort to solve a problem of increasing material cost and a problem of separating connectors from each other during the use due to the use of two connectors, and a problem vulnerable to discharging, at the time of connecting an antenna to a radio communication module embedded in electronic products.

Further, the present invention has been made in an effort to provide a radio communication module configured to facilitate discharging while being easily connected to an antenna using one connector.

According to a preferred embodiment of the present invention, there is provided a radio communication module, including: a printed circuit board provided with a receiving unit receiving a radio wave and provided with a via hole; an antenna including a connector which has a transmitting unit connected to the receiving unit formed thereat and forms a ring part outwardly bent at a tip thereof and forms a cut part at a circumference thereof so that the ring part is elastically deformed so as to be inserted and fastened into the via hole; a ground GND formed on the printed circuit board; and a discharge unit disposed between the receiving unit and the ground and including an ESD diode and a discharge line guiding electrostatic discharge (ESD) introduced from the outside to the ground.

The antenna may include: an antenna cable having a connector disposed at one end thereof; and an antenna substrate having the other end of the antenna cable mounted thereon.

The receiving unit may be a radio frequency signal pad.

The cut part may be radially divided.

The connector may have a guide part protruding therein and an insertion hole into which the guide part is inserted may be formed on the printed circuit board.

According to another preferred embodiment of the present invention, there is provided a radio communication module, including: a printed circuit board provided with a receiving unit receiving a radio wave and provided with a via hole; an antenna including a connector which has a transmitting unit connected to the receiving unit formed thereat and forms a ring part outwardly bent at a tip thereof and forms a cut part at a circumference thereof so that the ring part is elastically deformed so as to be inserted and fastened into the via hole; a ground GND formed on the printed circuit board; and a discharge unit disposed between the receiving unit and the ground and including a discharge inducing unit and a discharge line guiding electrostatic discharge (ESD) or surge introduced from the outside to the ground.

The antenna may include: an antenna cable having a connector disposed at one end thereof; and an antenna substrate having the other end of the antenna cable mounted thereon.

The receiving unit may be a radio frequency signal pad.

The cut part may be radially divided.

The connector may have a guide part protruding therein and an insertion hole into which the guide part is inserted may be formed on the printed circuit board.

The discharge inducing unit may have a triangular shape or a spark shape in which the triangle is symmetrically formed.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
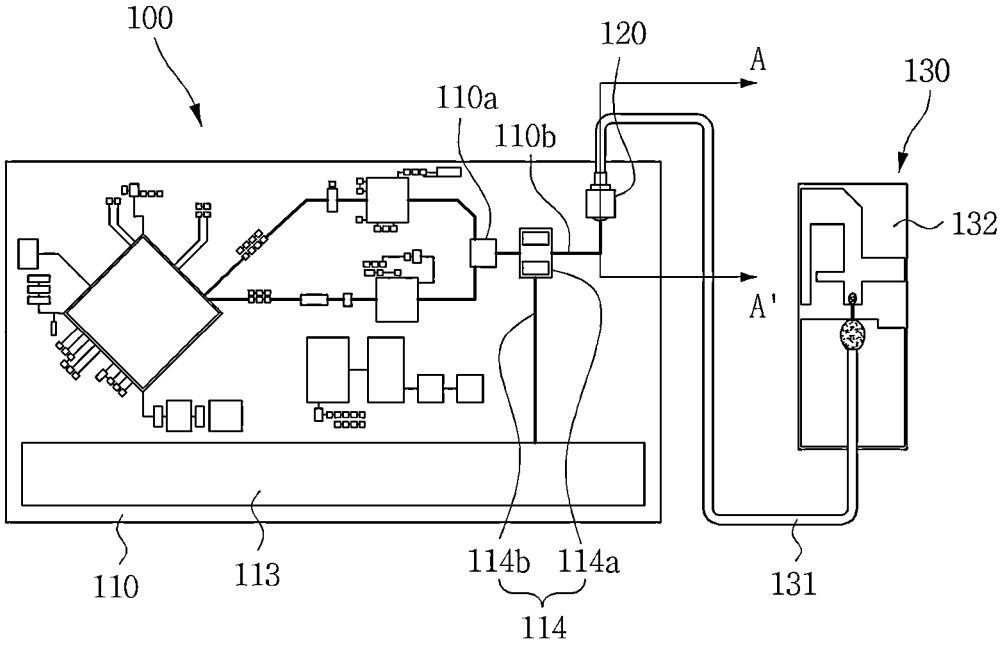
FIG. 1 is a schematic diagram illustrating a configuration of a radio communication module according to a preferred embodiment of the present invention.

The objects, features and advantages of the present invention will be more clearly understood from the following detailed description of the preferred embodiments taken in conjunction with the accompanying drawings. Throughout the accompanying drawings, the same reference numerals are used to designate the same or similar components, and redundant descriptions thereof are omitted. Further, in the following description, the terms "first", "second", "one side", "the other side" and the like are used to differentiate a certain component from other components, but the configuration of such components should not be construed to be limited by the terms. Further, in the description of the present invention, when it is determined that the detailed description of the related art would obscure the gist of the present invention, the description thereof will be omitted.

Hereinafter, preferred embodiments of the present invention will be described in detail with reference to the attached drawings.

A radio communication module according to a preferred embodiment of the present invention is embedded in products for consumer electronics (CEs) which include a set top box, a television, a printer, and the like, to wirelessly connect these products to each other. That is, as an example, the radio communication module has various circuit devices required for wireless communication mounted therein to be able to use Wi-Fi and includes a receiving unit which receives a radio wave, a printed circuit board (PCB) on which vial holes are formed, and an external patch antenna (ANT) which is provided with a transmitting unit connected to the receiving unit and is connected to the printed circuit board through a connector.

Herein, the connector having a circular shape is fastened to the printed circuit board by an insertion type, by forming a ring portion outwardly bent at a tip of the connector inserted into a via hole and forming a cut part on a circumference of the connector so that the ring portion is elastically deformed. Therefore, the receiving unit of the printed circuit board is electrically connected to the transmitting unit of the antenna through one connector without using two connectors like the prior art.

Further, the receiving unit formed on the printed circuit board may be formed in a form of a radio frequency signal pad which is disposed at a central portion of the via hole and is connected to the transmitting unit during the insertion and fastening of the connector to the via hole.

Meanwhile, the external patch antenna (ANT) may be provided as an antenna module in which the connector is provided at one end of an antenna cable and the other end of the antenna cable is mounted on an antenna substrate.

Herein, in the radio communication module according to the preferred embodiment of the present invention, for example, to cope with a damage of circuit devices, and the like, at the time of handling products for consumer electronics or due to electrostatic discharge (ESD) introduced through the antenna, a ground (GND) is formed on the printed circuit board and a discharge unit is disposed between the ground and the receiving unit but includes an ESD diode and a discharge line.

That is, when a voltage above a level required in the radio communication module is introduced, the ESD diode and the discharge line discharge the voltage to the ground to prevent various circuit devices, and the like, which are mounted on the printed circuit board, from being damaged.

On the other hand, in order to cope with the electrostatic discharge (ESD) and the surge, the ground GND is positioned on the substrate and the discharge unit is formed between the ground GND and the receiving unit and the discharge unit includes a discharge inducing unit and the discharge line to guide the electrostatic discharge (ESD) or the surge to the ground GND, thereby preventing the circuit devices, and the like, from being damaged.

The discharge inducing unit uses an electrical characteristic of the electrostatic discharge, that is, a moving characteristic of electrical charges from a wide area to a narrow area when the electrical charges meet a predetermined area, such as a pad, to direct the wide area to the receiving unit and direct the narrow area to the ground, thereby guiding and discharging the electrostatic discharge or the surge introduced through the antenna to the ground. In this case, the widening and narrowing of the area is to be construed as the relative concept.

Hereinafter, a preferred embodiment of the present invention is described hereafter in detail with reference to the accompanying drawings.

Embodiment 1

Figure 2:
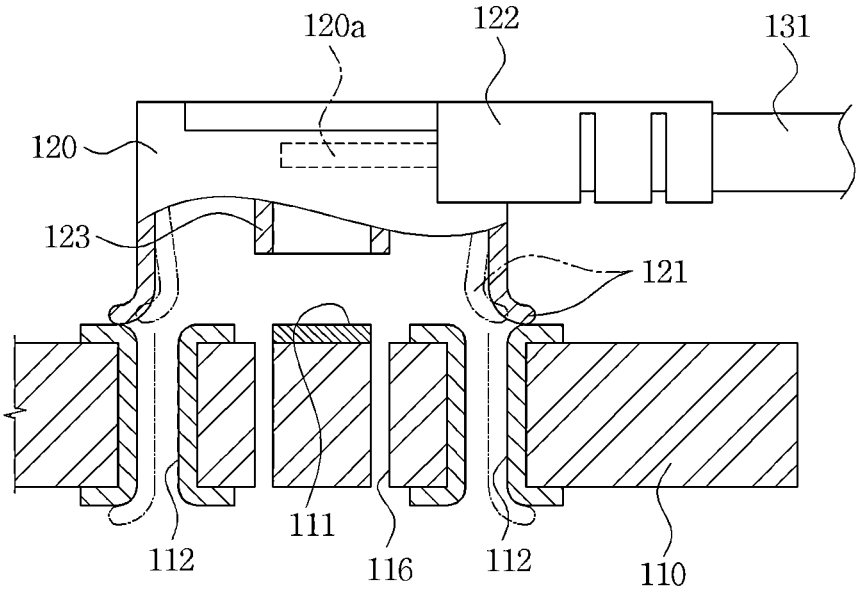
FIG. 2 is a partially enlarged cross-sectional view of the line A-A' of FIG. 1.

As illustrated in FIGS. 1 and 2, a printed circuit board 110 forms a through hole on a through hole and then plates and patterns the through hole to form a via hole 112. Further, a center of the via hole 112 is provided with the radio frequency signal pad as a receiving unit 111, and thus a connector 120 is naturally connected to a transmitting unit 120*a* at the time of being inserted and fastened to the via hole 112.

The via hole 112 is formed to have the same diameter as an outer diameter of a connector 120 to structurally lock the ring part 121 to the via hole 112 at the time of inserting the ring part 121 outwardly bent into a tip of the connector 120, such that the ring part 121 is elastically deformed inwardly.

The printed circuit board 110 on which the via hole 112 and the receiving unit 111 are formed has a ground 113 formed on a lower portion thereof in the drawings. In this case, the ground 113 means an area in which there is no circuit device 110*a* and it is to be noted that a position thereof may be changed depending on a size of the printed circuit board 110 and a configuration of the circuit.

A discharge unit 114 guiding the electrostatic discharge (ESD) to the ground 113 is configured by being mounted on a signal line, which is formed by a plating method or a printing method, so as to electrically connect an ESD diode 114*a* to the receiving unit 111 and the circuit device 110*a* and forming a discharge line 114*b* between the ESD diode 114*a* and the ground 113.

That is, when being viewed based on the drawings, the ESD diode 114*a* is formed in the middle of the signal line

110*b* which electrically connects the receiving unit 111 to the circuit device 110*a* and the discharge line 114*b* is formed between the ESD diode 114*a* and the ground 113, thereby guiding and discharging the electrostatic discharge ESD introduced through the antenna 130 to the ground 113. Therefore, the damage of the circuit device 110*a* due to the electrostatic discharge (ESD) is prevented.

Meanwhile, the connector 120 is formed in a circular shape using a thin cooper plate and the tip thereof is formed in a shape rounded outwardly, thereby forming the ring part 121. That is, the ring part 121 protrudes slightly larger than the outer diameter of the connector 120 to form a round, such that the ring part 121 is inserted and fastened to the via hole 112 formed on the printed circuit board 110.

Further, the connector 120 has a clamp 122 formed at an outside thereof so as to be provided at a tip of an antenna cable 131, in which the antenna cable 131 is mounted on an antenna substrate 132 by a soldering method, and the like, thereby forming the antenna 130 as a kind of module. In this case, the antenna cable 131 has a wire without being coated, which is disposed in the connector 120, to serve as the transmitting unit 120*a*.

Further, the inside of the connector 120 is provided with a guide part 123, which is formed in a kind of protrusion, so that the transmitting unit 120*a* is easily connected to the receiving unit 111 formed on the printed circuit board 110. Therefore, under the structure, an insertion hole 116 into which the guide part 123 is inserted is formed on the printed circuit board 110.

Figure 3:
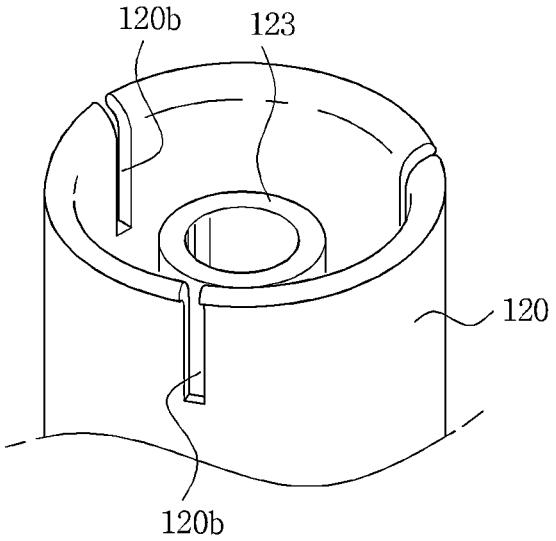
FIG. 3 is a partially enlarged perspective view of a connector according to a preferred embodiment of the present invention.

As illustrated in FIG. 3, the connector 120 has a cut part 120*b* formed at a circular circumference thereof to assist the elastic action of the ring part 121. In this case, the cut part 120*b* is radially divided into three based on the center of the connector 120. That is, the three divided cut part 120*b* easily induces the elastic action of the ring part 121 at the time of inserting the connector 120 into the via hole 112 formed on the substrate 110.

Therefore, in the radio communication module 100 according to the preferred embodiment of the present invention, the ring part 121 is fastened by being easily elastically deformed inwardly through the cut part 120*b* at the time of inserting the connector 120 into the via hole 112 formed on the substrate 110 and is fastened to the printed circuit board 110, with making a kind of 'click' sound while being recovered to an original shape after completely penetrating through the via hole 112, to connect the antenna 130 to the radio communication module 100, such that the operator may easily confirm the connection state.

Embodiment 2

Figure 4:
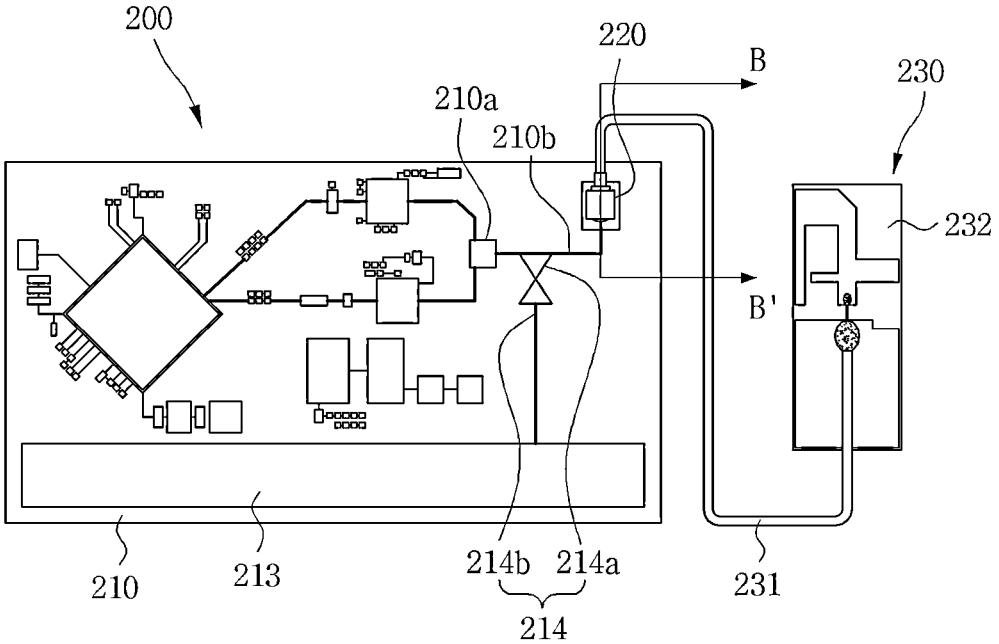
FIG. 4 is a schematic diagram illustrating a configuration of a radio communication module according to another preferred embodiment of the present invention.
Figure 5:
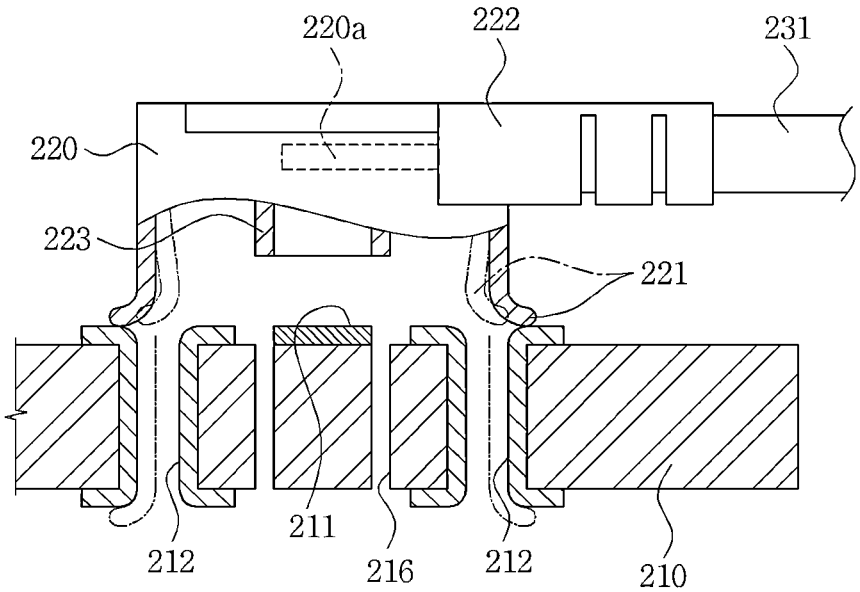
FIG. 5 is a partially enlarged cross-sectional view of the line B-B' of FIG. 4.

As illustrated in FIGS. 4 and 5, a printed circuit board 210 forms a through hole on a through hole and then plates and patterns the through hole to form a via hole 212. Further, a center of the via hole 212 is provided with the radio frequency signal pad as a receiving unit 211, and thus a connector 220 is naturally connected to a transmitting unit 220*a* at the time of being inserted and fastened to the via hole 212.

The via hole 212 is formed to have the same diameter as an outer diameter of a connector 220 to structurally lock the ring part 221 to the via hole 212 at the time of inserting the ring part 221 outwardly bent into a tip of the connector 220, such that the ring part 221 is elastically deformed inwardly.

The printed circuit board 210 on which the via hole 212 and the receiving unit 211 are formed has a ground 213 formed on a lower portion thereof in the drawings. In this case, the ground 213 means an area in which there is no circuit device 210*a* and it is to be noted that a position thereof may be changed depending on a size of the printed circuit board 210 and a configuration of the circuit.

A discharge unit 214 guiding the electrostatic discharge (ESD) or the surge to the ground 213 is configured by being mounted on a signal line 210*b* in a thin film type, which is formed by a plating method or a printing method, so as to electrically connect a discharge inducing unit 214*a* to the receiving unit 211 and the circuit device 210*a* and forming a discharge line 214*b* between the discharge inducing unit 214*a* and the ground 213.

That is, the discharge inducing unit 214*a* has a triangular shape or a spark shape in which a triangular shape is symmetrically formed and when being viewed based on the drawings, the discharge inducing unit 214*a* is formed so that a wide area meets the signal line 210*b* which electrically connects the receiving unit 211 to the circuit device 210*a* and the discharge line 214*b* is formed between the discharge inducing unit 214*a* and the ground 213, thereby guiding and discharging the electrostatic discharge (ESD) or the surge to the ground 213.

Therefore, it is possible to easily prevent the circuit devices 210*a* from being damaged due to the electrostatic discharge (ESD) introduced through the antenna 230 and the surge which is a voltage stronger than the electrostatic discharge ESD.

Meanwhile, the connector 220 is formed in a circular shape using a thin cooper plate and the tip thereof is formed in a shape rounded outwardly, thereby forming the ring part 221. That is, the ring part 221 protrudes slightly larger than the outer diameter of the connector 220 to form a round, such that the ring part 221 is inserted and fastened to the via hole 212 formed on the printed circuit board 210.

Further, the connector 220 has a clamp 222 formed at an outside thereof so as to be provided at a tip of an antenna cable 231, in which the antenna cable 231 is mounted on an antenna substrate 232 by a soldering method, and the like, thereby forming the antenna 230 as a kind of module. In this case, the antenna cable 231 has a wire without being coated, which is disposed in the connector 220, to serve as the transmitting unit 220*a*.

Further, the inside of the connector 220 is provided with a guide part 223, which is formed in a kind of protrusion, so that the transmitting unit 220*a* is easily connected to the receiving unit 211 formed on the printed circuit board 210. Therefore, under the structure, an insertion hole 216 into which the guide part 223 is inserted is formed on the printed circuit board 210.

Figure 6:
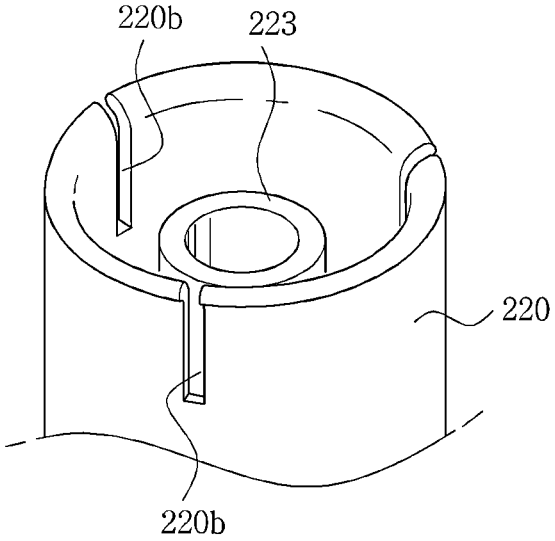
FIG. 6 is a partially enlarged perspective view of a connector according to another preferred embodiment of the present invention.

As illustrated in FIG. 6, the connector 220 has a cut part 220*b* formed at a circular circumference thereof to assist the elastic action of the ring part 221. In this case, the cut part 220*b* is radially divided into three based on the center of the connector 220. That is, the three divided cut part 220*b* easily induces the elastic action of the ring part 221 at the time of inserting the connector 220 into the via hole 212 formed on the substrate 210.

Therefore, in the radio communication module 200 according to the preferred embodiment of the present invention, the ring part 221 is fastened by being easily elastically deformed inwardly through the cut part 220*b* at the time of inserting the connector 220 into the via hole 212 formed on the substrate 210 and is fastened to the printed circuit board 210, with making a kind of 'click' sound while being recovered to an original shape after completely penetrating through the via hole 212, to connect the antenna 230 to the radio communication module 200, such that the operator may easily confirm the connection state.

According to the preferred embodiments of the present invention, it is possible to save the material cost due to the use of the connector by easily connecting the antenna to the radio communication module through the one connector without using the two connectors like the prior art. Further, the connector diffuses sound to the outside when being inserted and fastened to the via hole, such that the operator may easily confirm the fastened state, thereby improving the workability.

Further, it is possible to easily prevent the devices from being damaged due to the electrostatic discharge introduced from the outside, such as an antenna, by including the discharge unit which is configured to include a ground, an ESD diode, and a discharge line.

Meanwhile, according to the preferred embodiments of the present invention, it is possible to easily prevent the circuit devices from being damaged due to the electrostatic discharge or the surge introduced from the outside, by easily connecting the antenna to the radio communication module through the one connector and including the discharge unit which is configured to include the ground, the discharge inducing unit, and the discharge line.

Although the embodiments of the present invention have been disclosed for illustrative purposes, it will be appreciated that the present invention is not limited thereto, and those skilled in the art will appreciate that various modifications, additions and substitutions are possible, without departing from the scope and spirit of the invention.

Accordingly, any and all modifications, variations or equivalent arrangements should be considered to be within the scope of the invention, and the detailed scope of the invention will be disclosed by the accompanying claims.

What is claimed is:

1. A radio communication module, comprising:

a printed circuit board (PCB) comprising: a receiving unit configured to receive a radio wave, a via hole, and a ground disposed on the PCB;

an antenna, comprising a connector configured to connect to a transmitting unit and to the receiving unit, the connector comprising a cylindrically shaped ring part formed from a thin cooper plate, the ring part comprising a portion outwardly bent at a tip thereof, and the ring part comprising a cut part disposed at a circumference thereof, the cut part enabling the ring part to be elastically deformed so as to be inserted into and fastened by the via hole;

a discharge unit disposed between the receiving unit and the ground, and comprising an electrostatic discharge (ESD) diode and a discharge line, wherein the discharge unit is configured to guide ESD introduced from the outside to the ground.

2. The radio communication module as set forth in claim 1, wherein the antenna comprises:

an antenna cable, comprising a connector disposed at one end of the antenna cable; and an antenna substrate, having the other end of the antenna cable mounted thereon.

3. The radio communication module as set forth in claim 1, wherein the receiving unit comprises a radio frequency signal pad.

4. The radio communication module as set forth in claim 1, wherein the cut part is radially divided by a slit disposed along the axis of the ring part.

5. The radio communication module as set forth in claim 1, wherein the connector comprises a guide part protruding therefrom and wherein an insertion hole into which the guide part is inserted is formed in the printed circuit board.

6. A radio communication module, comprising:

a printed circuit board (PCB) comprising: a receiving unit configured to receive a radio wave, a via hole, and a ground disposed on the PCB;

an antenna, comprising a connector configured to connect to a transmitting unit and to the receiving unit, the connector comprising a cylindrically shaped ring part formed from a thin cooper plate, the ring part comprising a portion outwardly bent at a tip thereof, and the ring part comprising a cut part disposed at a circumference thereof, the cut part enabling the ring part to be elastically deformed so as to be inserted into and fastened by the via hole;

a discharge unit disposed between the receiving unit and the ground, and comprising a discharge inducing unit and a discharge line, wherein the discharge unit is configured to guide electrostatic discharge (ESD) or surge introduced from the outside to the ground.

7. The radio communication module as set forth in claim 6, wherein the antenna comprises:

an antenna cable, comprising the connector disposed at one end of the antenna cable; and an antenna substrate, having the other end of the antenna cable mounted thereon.

8. The radio communication module as set forth in claim 6, wherein the receiving unit comprises a radio frequency signal pad.

9. The radio communication module as set forth in claim 6, wherein the cut part is radially divided by a slit disposed along the axis of the ring part.

10. The radio communication module as set forth in claim 6, wherein the connector comprises a guide part protruding therefrom, and wherein an insertion hole into which the guide part is inserted is formed in the printed circuit board.

11. The radio communication module as set forth in claim 6, wherein the discharge inducing unit has a triangular shape or a spark shape in which the triangle is symmetrically disposed.

* * * * *